United States Patent [19]

Turcsány et al.

[11] Patent Number: 4,632,007

[45] Date of Patent: Dec. 30, 1986

[54] PAGE-TURNING DEVICE ASSEMBLED SUITABLY WITH ACTUATING MECHANISM

[75] Inventors: József Turcsány; Pál Gál; István Borbás, all of Budapest, Hungary

[73] Assignee: Licencia Találmányokat Értékesitö Vállalat, Budapest, Hungary

[21] Appl. No.: 691,726

[22] Filed: Jan. 15, 1985

Related U.S. Application Data

[63] Continuation of Ser. No. 445,297, Nov. 29, 1982, abandoned.

[30] Foreign Application Priority Data

Nov. 27, 1981 [HU] Hungary ..... 3555/81

[51] Int. Cl.[4] ..... G10G 7/00

[52] U.S. Cl. ..... 84/487; 84/508

[58] Field of Search ..... 84/486–521

[56] References Cited

U.S. PATENT DOCUMENTS

| | | | |
|---|---|---|---|
| 188,915 | 3/1877 | Jensen | 40/370 |
| 370,410 | 9/1887 | Post | 40/370 |
| 1,038,662 | 9/1912 | Ryan | 84/487 |
| 1,087,336 | 2/1914 | Thurber | 40/530 |
| 1,156,199 | 10/1915 | Anderson et al. | 84/486 |
| 2,484,106 | 10/1949 | Mallina | 84/487 X |

FOREIGN PATENT DOCUMENTS

| | | | |
|---|---|---|---|
| 1121233 | 7/1956 | France | 84/487 |
| 1212934 | 3/1960 | France | 84/487 |

*Primary Examiner*—Lawrence R. Franklin

*Attorney, Agent, or Firm*—Gabriel P. Katona

[57] ABSTRACT

The invention relates to a page-turning device for turning over the pages of periodicals, newspapers etc., mainly for handicapped persons, as well as for turning over the pages of music note, which has a stand and actuating mechanism provided suitably with bobbin.

The problem is solved according to the invention with a cord with releasable fastening fixed at least in one point suitably along the side-edge of pages arranged on stand, which cord led through eyelets formed on the side of the folding line in the direction of page-turning is interconnected with an actuating mechanism.

The most important advantage of the solution according to the invention is found in that—in addition to its simple construction—it can be used even by patients suffering from serious locomotor disease with the aid of stand mounted on hospital bed and with actuating mechanism operated by nod of the head in extreme cases. Otherwise a time switch or any other control unit can be used for operation.

3 Claims, 16 Drawing Figures

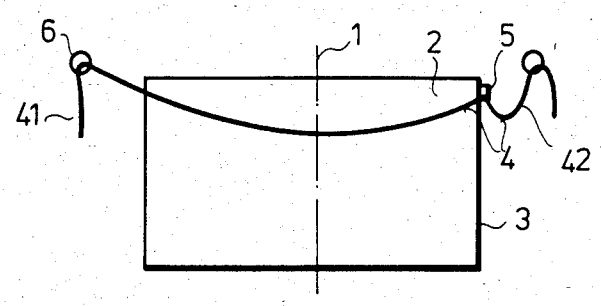
Fig. 2/a
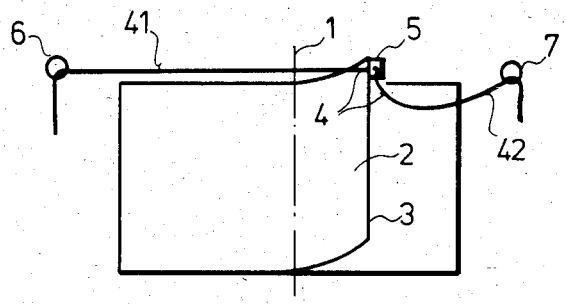
Fig. 2/b
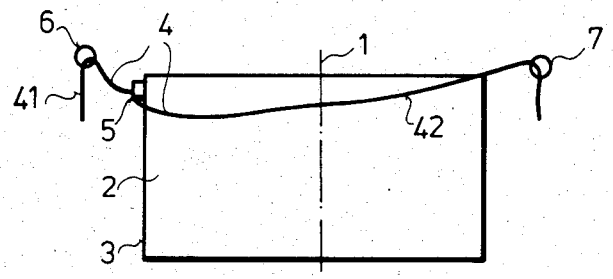
Fig. 2/c
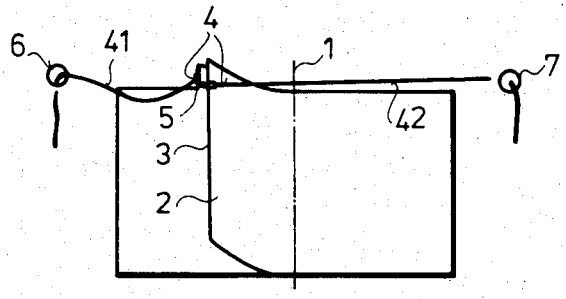
Fig. 2/d

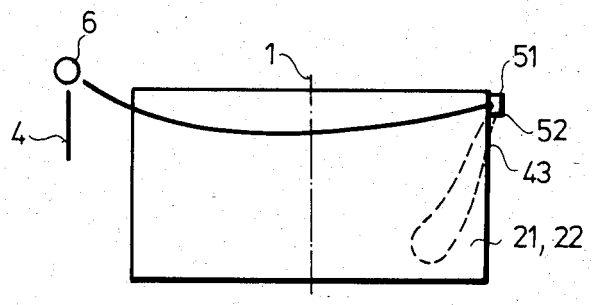
Fig. 3/a
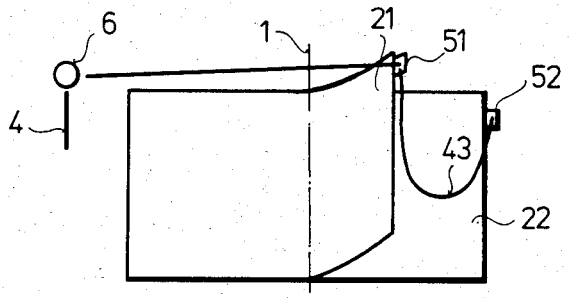
Fig. 3/b
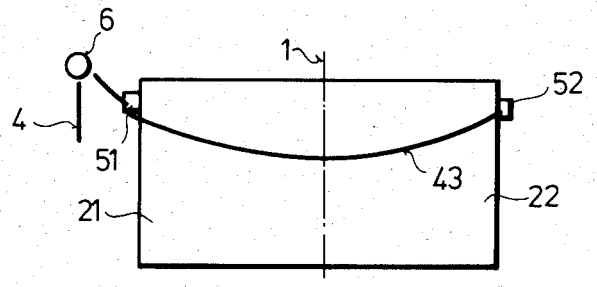
Fig. 3/c
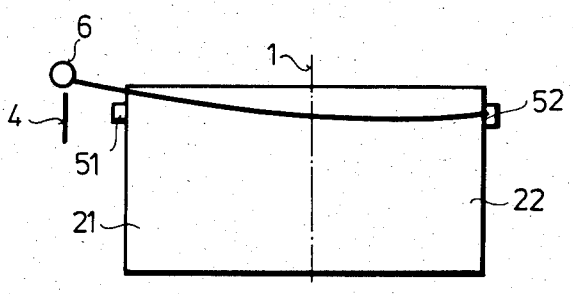
Fig. 3/d

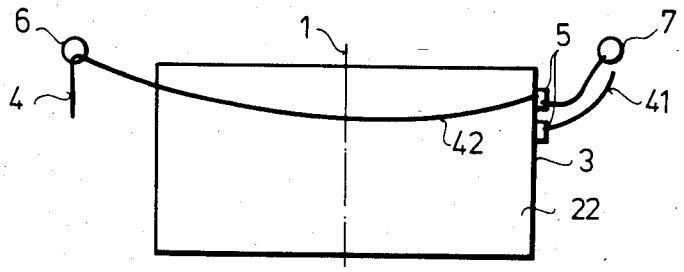
Fig. 4/a
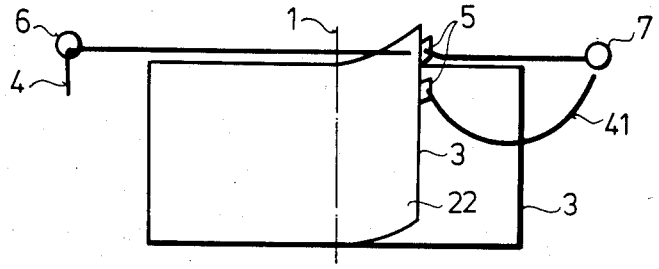
Fig. 4/b
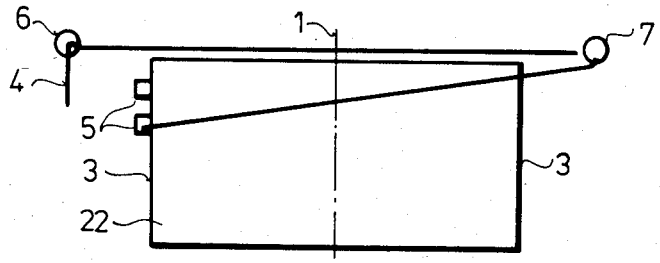
Fig. 4/c
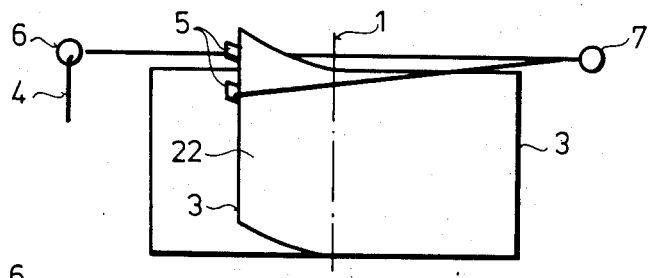
Fig. 4/d
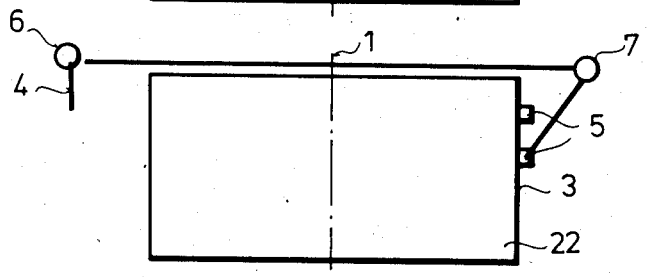
Fig. 4/e

PAGE-TURNING DEVICE ASSEMBLED SUITABLY WITH ACTUATING MECHANISM

This is a continuing application of application Ser. No. 445,297, filed on Nov. 29, 1982, now abandoned.

BACKGROUND

The invention relates to a page-turning device particularly for use as an aid for handicapped persons to turn-over the pages of newspapers, periodicals and music score, which device has a stand and actuating mechanism provided suitably with a bobbin.

According to French patent specification No. 1,121,233, pages are turned over with the aid of magnet-actuated metal wires fitted with rings sliding on an axis wherein the wires are inserted between the pages of a book or musical score on a reading board.

According to French patent specification No. 2,226,285, the pages of a book mounted on a reading board are actuated with arms provided with suction-grip disks.

The common drawback of the above devices is that the page-turning is carried out with a device fitted with a reading board constructed specially for this purpose, and only such pages can be turned over which conform to the dimensions of the reading board which is not separable from the page-turning device in the described devices.

Another fault of the devices according to the above French patent specification No. 2,226,285 is that the suction-grip disk is extremely unreliable and in cases of pages with a coarse surface, or having crinkled or worn pages, it fails.

Both apparatuses require many special parts and their production is expensive. Because of their size they can be used only on a table.

These drawbacks make the use of the above page-turning apparatuses considerably difficult for the intended purpose, and the inextricable difficulties of the arrangement and transportation of the reading boards practically exclude their use in the performing arts.

Apart from the described devices, there are devices which facilitate turning over of pages, especially for musicians.

In English patent specification No. 1,395,168, such a device is disclosed, where in order to facilitate reliably turning the pages over, elements mounted on arms rotatably embedded in a stand are inserted between the pages.

The drawback of this device is that it does not alter at all hand turning of the pages. This represents difficulty for musicians, especially for soloists, since they have to interrupt their play to turn the page over, or the aid of another person is necessary.

In order to eliminate the disadvantages of turning the pages over by hand, a "mechanized" device was worked out according to English patent specification No. 1,257,457, where an arm shaped like the puck of ice-hockey rotatable around the axis of page-turning is embedded in the holder of the music score, which arm is actuated between the two end-positions with a pedal-driven rope. A condition of the page-turning is that separating elements are placed between the pages which in normal position are arranged on the right side in relation to the axis of the page-turning. The arm is guided under each successive page by the separating elements, then upon completion of the page turning, the arm, returned with a spring, turns off the separating element above the page that fulfilled its function and the next one with a hook fixed to the arm.

The drawbacks of the device are that the complicated mechanism requires a specially shaped stand or holder and its operation is extremely noisy. The noise is absolutely inadmissable in case of turning the pages of a music score over and this was the decisive obstacle preventing its general use. The music stand too is complicated and expensive, and the number of pages of the book, music score, etc. to be turned over is limited to the number of the separating elements. Furthermore, as a result of the given structural length of the arm, the size of the page is limited within a narrow range. Apart from this, the device damages the pages and it is not suitable at all for turning back the pages.

The purpose of this invention is to provide a device assembled with simple parts and is suitable for page-turning according to several programs and is manageable by seriously handicapped persons as well.

SUMMARY OF THE INVENTION

According to the invention the problem is solved with the use of a cord fixed at least in one point with a releasable fastening suitably along the side-edge of the page(s) arranged on a stand, which cord, led through eyelets formed on the side of the stand in the direction of page-turning, is interconnected with the actuating mechanism.

BRIEF DESCRIPTION OF THE DRAWINGS

The invention is described in detail with the aid of the drawings, in which:

FIGS. 2*a*–2*d*, 3*a*–3*d*, and 4*a*–4*e* are diagrams showing operation of the device;

DETAILED DESCRIPTION

Figure 1:
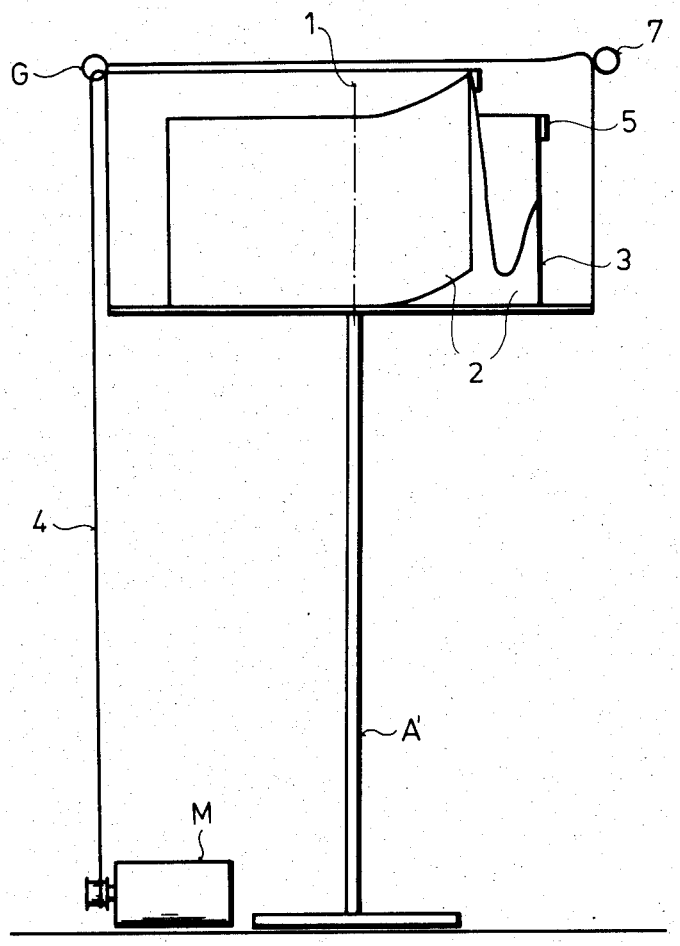
FIG. 1 is a front view of the page-turning device.

FIG. 1 shows the front view of the page-turning device, according to which the book, periodical, newspaper, music score or page to be turned over are arranged on a stand A'. Construction of the stand A' is optional, it may be for instance the music stand shown in the diagram. The folding line 1 around which the pages 2 are turned over is shown with a thin dot-dash line. Cord 4 is fixed to ears 5 with releasable fastening suitably along the side-edge 3 of page 2. The cord 4 in case of the alternative device demonstrated and suitable for the successive page-turning, the operation of which is shown in FIG. 3—is interconnected with actuating mechanism M through eyelet G mounted on stand A' arranged to the left from the folding line 1. It is noted, that in case of other alternatives, the eyelet 7 mounted on the right side of stand A' can also be used.

Construction of the actuating mechanism M is optional. Thus, the unit driven with the illustrated electric motor and provided with a bobbin can be mounted on stand A'. It is operated by hand or foot switch, but a construction with a pedal is also conceivable.

The switch can be operated in a special way, e.g. by nod of the head in case of patients suffering from serious disease.

FIGS. 2*a*–2*d* show a construction alternative of the page-turning device according to the invention suitable for optional number of page turning or back turning. In case of a single page 2, an optionally shaped clamping element, e.g. tape made of fabric, wire or strip of rubber is arranged in the folding line. In case of stitched or bound pages 2, this is unnecessary.

In our case the ear 5 is formed from self-adhesive tape, one part of which is fixed to page 2, while the free adhesive surface fixes the cord 4. The self-adhesive tape is perforated suitably in cross direction in order to ensure easy operation and separation.

A condition of the operation of the apparatus according to the invention is to arrange the ear 5 along the side-edge 3, since the force necessary for the page-turning is minimal in this case, and the cord 4 does not disturb the reading. Apart from this, the fixing point of cord 4 can be arranged along the side-edge at the top or bottom of the given page.

Strands 41 and 42 of cord 4 in this alternative are interconnected with the actuating mechanism M through the eyelets 6 and 7.

The alternatives shown in FIGS. *2a–2d* include the construction alternative which is suitable only for turning over a single page. Here, the cord 4 is led through eyelet 6 only.

Operation of this alternative is the following: FIG. *2a* shows the construction in ready to operate condition where strand 41 is tensioned by the actuating mechanism M, and by moving from right to left it carries the page 2 from the normal position on the right side to the left side end position in relation to the folding line 1 as shown in FIG. *2b*. Meanwhile, the strand 42 follows loosely the movement of page 2. End position of page 2 is shown in FIG. *2c*. In case of back-turning, the strand 42 is moved from left to right with the actuating mechanism M, and the page 2 passes from its end position according to FIG. *2d* to its normal position according to FIG. *2a*.

FIGS. *3a–3d* show the construction alternative of the apparatus according to the invention suitable for successive page turning of the last two pages. In case of this alternative, strand 43 of cord 4 is laid between pages 21 and 22, and the limiting points or short sections are fixed to ears 51 and 52. The cord is led through eyelet 6 only. It is noted that the shape of eyelets 6 and 7 may be different from the closed ring, e.g. it may be a U-shaped guiding element as well.

Description of the operation of this alternative according to the diagram-series is the following: The cord 4 is pulled to the left by operation of the actuating mechanism M and this way the page 21 is advanced from its normal position to the end position while strand 43 of the cord 4 between the ear 51 arranged on the page 21 and the other ear 52 fixed to page 22 follows loosely the movement of the first page 21. In this case, the ears 51 and 52 are shaped from self-adhesive tape, the releasable fastening is realized in such a way, that the force necessary for page-turning in normal position of both pages 21 and 22 and the forces loading the cord 4 and the strand 43 are smaller than the adhesive power. However, as soon as each of pages 21 and 22 pass to the end position, the situation according to FIG. *3c* will occur. Then during the movement of the cord 4 carried out with the actuating mechanism M, a force greater than the adhesive power of the self-adhesive tape will be applied to the cord 4 in the last section, because neither of the pages 21 or 22 can be moved in the given end position, thus causing the given strand of the cord 4 to break off the ear 51. This results in the situation according to FIG. *3d*, i.e. the apparatus is ready for page-turning again. The end of the cord is fixed to ear 5 formed on the last page in the succession.

It is noted that the expression "point" related to the fixing point of ears 5, 51 and 52 is not used in the geometrical sense, because the given ears 5, 51 and 52 have specific structural dimensions, and in case of the given sequence of pages, the ears 5, 51 and 52 do not necessarily cover each other in their geometrical position, moreover, they can be displaced in relation to each other along the side-edges 3.

In the device according to the invention, the cord 4 can be fixed in a great many variations such as, the adhesive substance or self-adhesive tape applied directly on pages 2, 21 and 22 may be made of fabric, or according to a further alternative, the pages 2, 21 and 22 are perforated along the side-edges 3 and the cord 4 is passed through the holes, knots releasable with dynamic force, i.e. pull, are formed on the points or sections separating the strands, or elements of plastic deformation, e.g. rubber strips, are fixed. For instance, paper clips can also be used for fastening.

FIGS. *4a–4e* show the diagram of operation of the page-turning device according to the invention, which, apart from successive page-turning, is suitable also for turning back the last page once. The field of application of this device extends first of all to playing musical compositions where the last part of the composition includes the condition of so-called "da capo al fine".

In this construction alternative partly the end of the cord 4 and partly the first and second sections from the end of the cord 4, i.e. the point separating the strands 41 and 42 are fixed on the page 22 as the last one in the sequence of page-turning, and strand 41 is led through the eyelet 7.

While moving the page 22 with the actuating mechanism M according to FIG. *4b*, the strand 41 follows the movement of page 22 loosely. When page 22 arrives at its end position and the cord 4 is torn off one of the ears 5, page 22 gets into the position suitable for turning back. Turning back the page is carried out according to FIGS. *4d* and *4e*.

Figure 5:
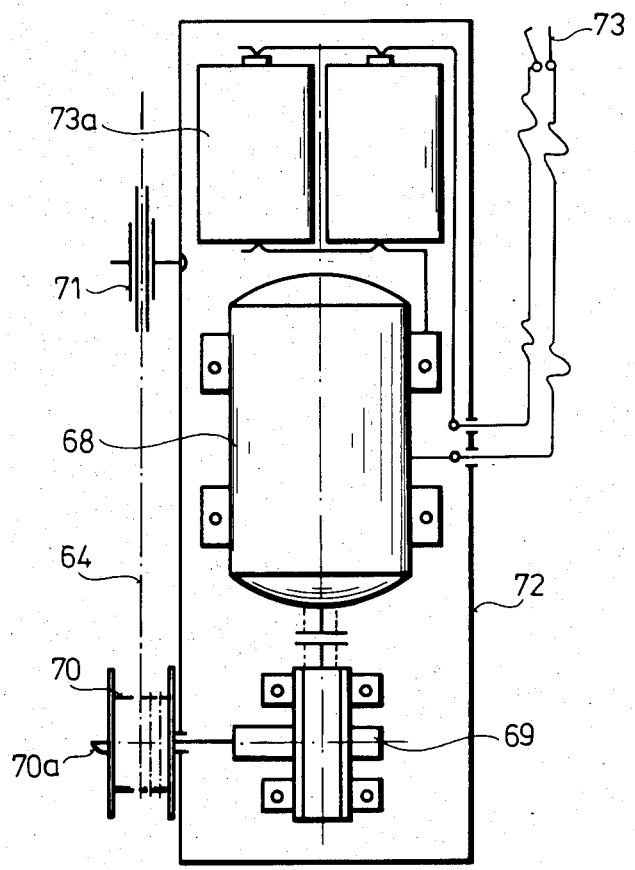
FIG. 5 is a schematic drawing of the actuating mechanism.

The actuating mechanism M, shown in FIG. 5, consists of the reducing gear 69 connected to electric motor 68. Spindle 70 is fixed to the shaft of the reducing gear 69 fixed by cam 70/a at the end of the shaft. The cord 4, wound up on spindle 70, passes to said spindle through the strand-tensioning device 71.

The electric motor 68 of the actuating mechanism M is operated suitably with a foot switch 73.

It is noted that the device can be made within the protective range with alternatives where the strand is substituted by the hard cover of the book or by the portfolio of a music score. From this it follows that in such cases the cord-guiding eyelets are formed for instance as tweezers.

Use of the portfolio has the advantage in that its rigidity ensures a stable position of the material to be read in any suspension method.

Figure 6:
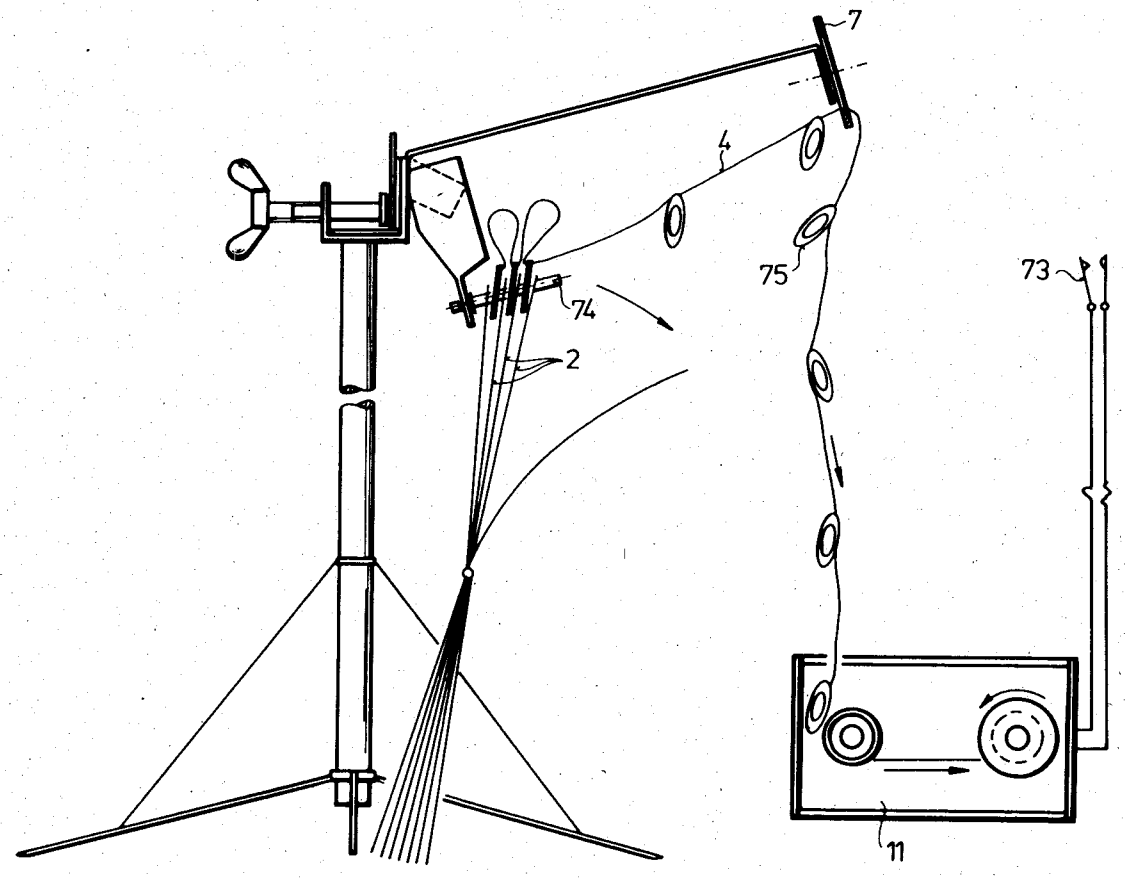
FIG. 6 is a side view of a preferred page-turning device.

FIG. 6 shows the device according to the invention, where the pages 2 of the book, music score or periodical are perforated on the same place.

The book fixed to the stand or to any fixed point is suspended suitably on horizontally arranged pin 74 by way of these perforations in such a way, that eyelets 75 fixed on cord 4 are used between all pages 2.

The cord 4 is in actuating connection with the previously described actuating mechanism M.

In this construction, the given page is carried along by eyelets 75, then, after turning over the page, it is detached from the eyelet. Besides the perforation, no other alterations are necessary on the book.

The most important advantage of the device according to the invention is found in that, in addition to the simple construction, it can be used even by patients suffering from serious locomotor disease with the aid of a stand mounted on a hospital bed and with the actuating mechanism by a nod of the head in extreme cases. Otherwise, a time switch, or any other control unit can be used for operation.

What we claim is:

1. A page turning device for turning pages of periodicals, newspapers, musical scores and the like, wherein the last page to be turned can be turned back to its original position, comprising:

a stand for supporting said pages;

two eyelets fixed on said stand, one eyelet being located beside said pages on the turned-page side and the other eyelet being located beside said pages on the to-be-turned page side;

fastening elements releasably fixed to the side edges of the pages to be turned, said last page having two releasable fastening elements thereon whereas the remaining pages to be turned have one releasable fastening element thereon;

a cord, one end of said core being connected to one of said two releasable fastening elements on said last page, said cord passing through said other eyelet and being connected to the other of said two releasable fastening elements on said last page, said cord being sequentially connected in reverse order to the pages preceding said last page to the first page to be turned, said cord then passing through said one eyelet; and an actuating mechanism connected to the other end of said cord and operative to draw said cord through said eyelets toward said actuating mechanism.

2. A page turning device as in claim 1 wherein said releasable fastening elements consist of a self-adhesive tape, one part of which is fixed to the page while the free adhesive surface fixes the cord.

3. A page turning device as in claim 1 wherein said actuating mechanism includes a strand tensioning device and a spindle fixed on a shaft connected to an electric motor through a reducing gear, said spindle winding said cord thereon when said motor is actuated.

* * * * *